US009410526B2

(12) United States Patent
Sekine

(10) Patent No.: US 9,410,526 B2
(45) Date of Patent: Aug. 9, 2016

(54) IGNITION DEVICE

(71) Applicant: SANKEN ELECTRIC CO., LTD., Niiza-Shi, Saitama (JP)

(72) Inventor: Nobuaki Sekine, Kawagoe (JP)

(73) Assignee: SANKEN ELECTRIC CO., LTD., Niiza-Shi (JP)

( * ) Notice: Subject to any disclaimer, the term of this patent is extended or adjusted under 35 U.S.C. 154(b) by 0 days.

(21) Appl. No.: 14/971,138

(22) Filed: Dec. 16, 2015

(65) Prior Publication Data

US 2016/0201637 A1 Jul. 14, 2016

(30) Foreign Application Priority Data

Jan. 8, 2015 (JP) ..... 2015-002226

(51) Int. Cl.
*F02P 9/00* (2006.01)
*F02P 15/12* (2006.01)

(52) U.S. Cl.
CPC ..... *F02P 15/12* (2013.01)

(58) Field of Classification Search
USPC ..... 315/209 T–209 S; 123/606–644
See application file for complete search history.

(56) References Cited

U.S. PATENT DOCUMENTS

2008/0074054 A1* 3/2008 Kang ..... H05B 41/042 315/209 T

FOREIGN PATENT DOCUMENTS

JP 2001-217131 A 8/2001

* cited by examiner

*Primary Examiner* — Thuy Vinh Tran
*Assistant Examiner* — Jonathan Cooper
(74) *Attorney, Agent, or Firm* — Mots Law, PLLC

(57) ABSTRACT

An ignition coil includes a first winding, a second winding, and a third winding. A first switch is electronically connected to a first end of the first winding. A battery is electronically connected to a second end of the first winding. A booster with a first end electronically connected to the battery and a second end electronically connected to a first end of the third winding. A second switch is electronically connected to a second end of the third winding. A drive device is electrically connected to the first and the second switches, that turns the first and the second switch on and off. The drive device feeds a secondary current to the second winding by changing the first switch from an on-state to an off-state, and supplies an output from the booster to the third winding by changing the second switch from an off-state to an on-state.

9 Claims, 6 Drawing Sheets

IGNITION DEVICE

CROSS REFERENCE TO RELATED APPLICATIONS

This application claims priority based on 35 USC 119 from prior Japanese Patent Application No. 2015-002226 filed on Jan. 8, 2015, entitled "IGNITION DEVICE", the entire contents of which are hereby incorporated by reference.

BACKGROUND

This disclosure relates to an ignition device provided with an ignition coil for an internal combustion engine.

As a conventional ignition device, there has been known an ignition device disclosed in Japanese Patent Application Publication No. 2001-217131 (Patent Document 1), for example. As illustrated in FIG. 6, the ignition device provided with an ignition coil described in Patent Document 1 includes igniter control circuit 11, igniter switch Q1, transformer Ta, battery E, and diode D5, and adopts a fly-back control method.

Igniter control circuit 11 inputs an ignition signal and turns igniter switch Q1 on and off by using the ignition signal. Energy is stored in transformer Ta while igniter switch Q1 is on, and the energy stored in transformer Ta is supplied to plug 16 when igniter switch Q1 is turned off, and plug 16 is thus ignited.

SUMMARY

An embodiment of an ignition device comprises an ignition coil including a first winding, a second winding, and a third winding electromagnetically coupled to one another, a first switch electronically connected to a first end of the first winding, a battery electronically connected to a second end of the first winding, a booster with a first end electronically connected to the battery and a second end electronically connected to a first end of the third winding, a second switch electronically connected to a second end of the third winding, and a drive device electrically connected to the first and the second switches, that turns the first and the second switch on and off, wherein the drive device feeds a secondary current to the second winding by changing the first switch from an on-state to an off-state, and supplies an output from the booster to the third winding by changing the second switch from an off-state to an on-state.

DETAILED DESCRIPTION

Figure 1:
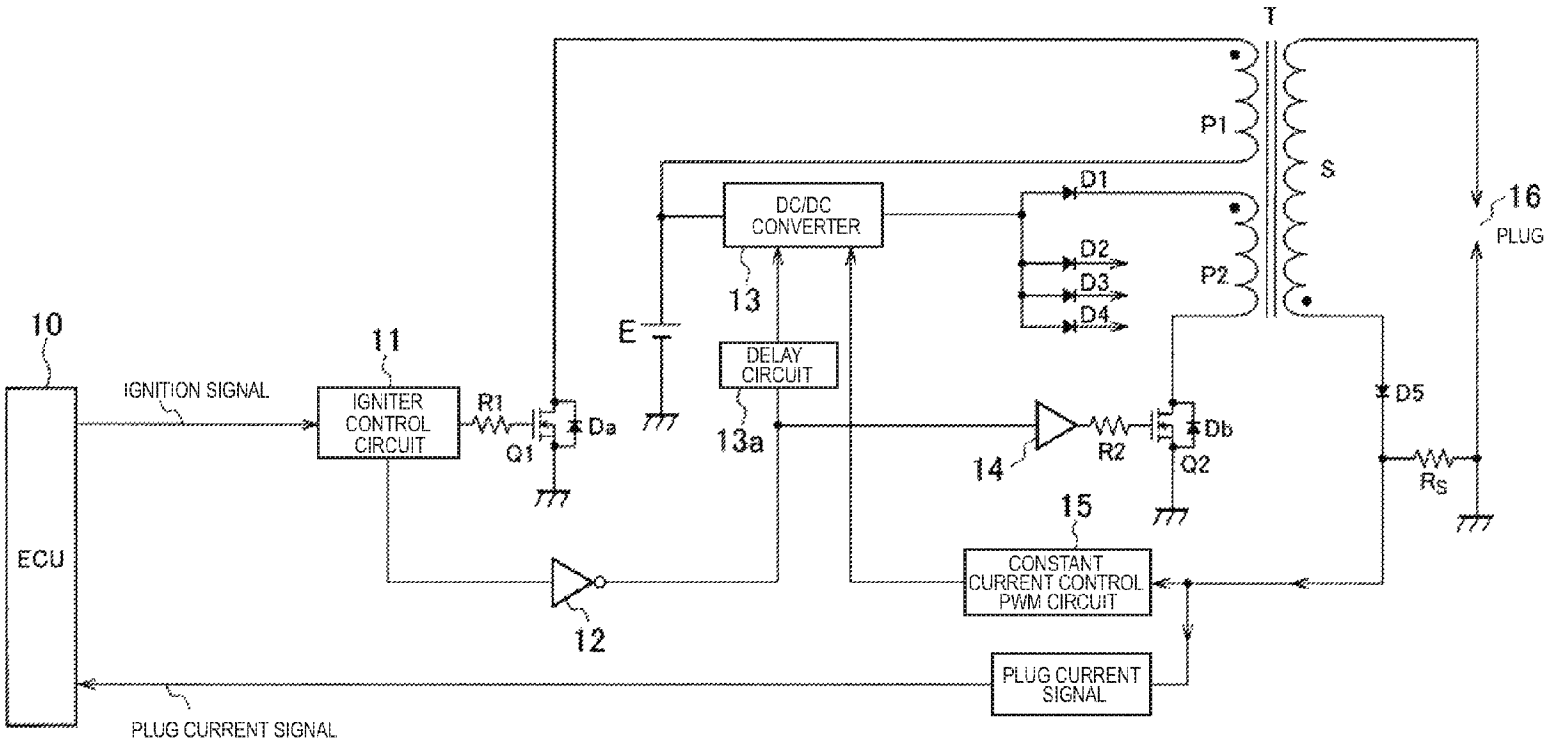
FIG. 1 is a diagram illustrating a circuit configuration of an ignition device according to Example 1.

Embodiments are described below in detail with reference to the drawings. FIG. 1 is a diagram illustrating a circuit configuration of an ignition device according to Example 1. Note that constituents in FIG. 1, which are the same as those in the conventional ignition device illustrated in FIG. 6 are denoted by the same reference numerals used in the description of the background.

Figure 6:
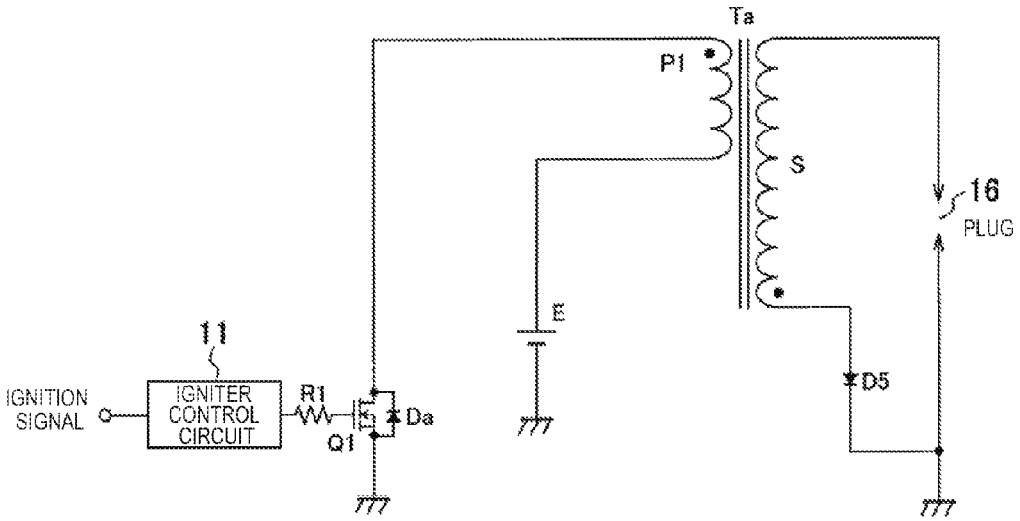
FIG. 6 is a diagram illustrating a circuit configuration of a conventional ignition device.

In the conventional ignition device illustrated in FIG. 6, electric power is supplied only from the battery. On the other hand, in the following example, electric power is supplied from an auxiliary boost converter to energy superposition winding. In addition, the ignition device of the example controls a constant current by detecting a plug current and feeding the detected plug current back to the auxiliary boost converter.

The ignition device of Example 1 includes igniter control circuit 11, igniter switch Q1, transformer T, battery E, diodes D1 to D5, Da, and Db, inverter 12, DC/DC converter 13, delay circuit 13*a*, buffer circuit 14, constant current control PWM circuit 15, MOSFET Q2, resistors R1 and R2, and shunt resistor Rs.

Engine control unit (ECU) 10 outputs an ignition signal to igniter control circuit 11. Igniter control circuit 11 receives the ignition signal from ECU 10, and turns igniter switch Q1 on and off via resistor R1 by using the ignition signal. Igniter switch Q1 corresponds to a first switch and includes an N-type MOSFET.

Transformer T corresponds to an ignition coil and includes igniter winding P1 (corresponding to a first winding), secondary winding S (corresponding to a second winding) in a reverse phase to igniter winding P1, and energy superposition winding P2 (corresponding to a third winding), which are electromagnetically coupled to one another.

One end of igniter winding P1 is connected to a drain of igniter switch Q1. Meanwhile, a positive electrode of battery E is connected to another end of igniter winding P1 while a negative electrode of battery E is grounded. Diode Da is connected between the drain and a source of igniter switch Q1. Diode Da may be a parasitic diode in igniter switch Q1.

Inverter 12 inverts the ignition signal from igniter control circuit 11 and outputs the inverted ignition signal to buffer circuit 14. Delay circuit 13*a* delays the inverted ignition signal from inverter 12 by a predetermined time period and then outputs the signal to DC/DC converter 13.

DC/DC converter 13 corresponds to a booster, which boosts a voltage of battery E by using the inverted ignition signal from inverter 12, and supplies the boosted voltage to anodes of four diodes D1 to D4 that are connected in parallel.

Four diodes D1 to D4 are provided corresponding to four cylinders of an internal combustion engine. In FIG. 1, one end of energy superposition winding P2 is connected to a cathode of diode D1. Meanwhile, a drain of MOSFET Q2 is connected to another end of energy superposition winding P2 while a source of MOSFET Q2 is grounded. Diode Db is connected between the drain and the source of MOSFET Q2. Diode Db may be a parasitic diode in MOSFET Q2.

Here, although not illustrated, one end of winding corresponding to energy superposition winding P2 is also connected to a cathode of each of diodes D2 to D4. In the meantime, a drain of a MOSFET corresponding to MOSFET Q2 is connected to another end of the winding while a source of such a MOSFET is grounded.

MOSFET Q2 (corresponding to a second switch) is formed from an N-type MOSFET. MOSFET Q2 is turned on and off by the inverted ignition signal from inverter 12 inputted to a gate of MOSFET Q2 via buffer circuit 14.

Meanwhile, DC/DC converter 13 operates to continue supply of electric energy to energy superposition winding P2 in response to an internal signal to be described later during a period when MOSFET Q2 is in an on-state. In this regard, DC/DC converter 13 starts supply of the electric energy after a lapse of a predetermined time period from a point when MOSFET Q2 is changed from an off-state to the on-state.

Igniter control circuit 11 and inverter 12 correspond to a drive device. The drive device feeds a secondary current to secondary winding S by changing igniter switch Q1 from an on-state to an off-state, and supplies an output from DC/DC converter 13 to energy superposition winding P2 by changing MOSFET Q2 from the off-state to the on-state, thereby extending a time period for supplying the secondary current.

One end of plug 16 is connected to one end of secondary winding S of transformer T, and an anode of diode D5 is connected to another end of secondary winding S. A cathode of diode D5 is connected to one end of shunt resistor Rs and to an input terminal of constant current control PWM circuit 15. Another end of shunt resistor Rs is connected to another end of plug 16 and to the ground. A plug current signal from shunt resistor Rs is outputted to ECU 10.

Constant current control PWM circuit 15 outputs to DC/DC converter 13 the internal signal for controlling the secondary current at a constant value by detecting the secondary current flowing on secondary winding S of the ignition coil while using shunt resistor Rs, and comparing a detected value with an internal reference value.

Here, constant current control PWM circuit 15 illustrated in FIG. 1 is provided outside DC/DC converter 13. Instead, constant current control PWM circuit 15 may be provided inside DC/DC converter 13, for example.

Next, an operation of the ignition device of the example thus configured is described in detail with reference to an operation waveform diagram illustrated in FIG. 2 regarding the constituents of the ignition device.

Figure 2:
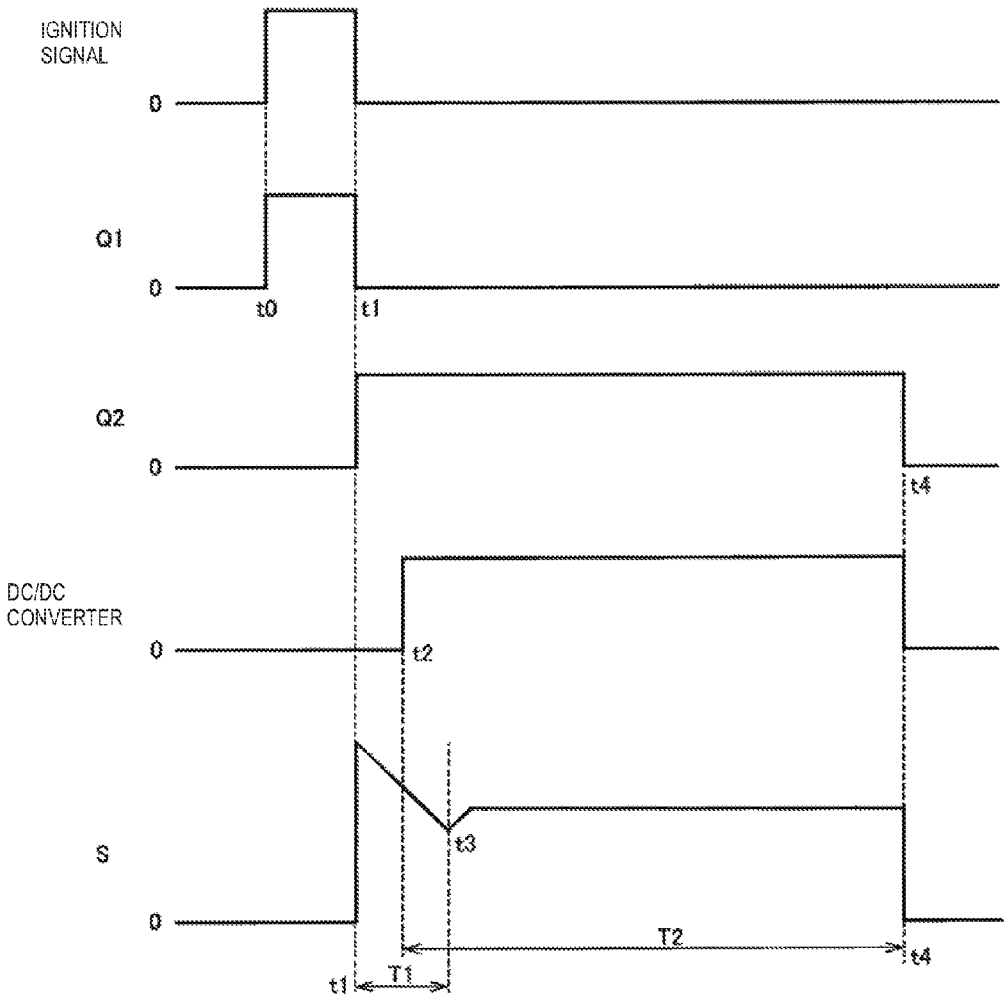
FIG. 2 is an operation waveform diagram regarding constituents of the ignition device according to Example 1.

Note that in FIG. 2, a line indicated with IGNITION SIGNAL represents a signal sent from ECU 10, a line Q1 represents an output from igniter switch Q1, a line Q2 represents an output from MOSFET Q2, a line DC/DC CONVERTER represents an output from DC/DC converter 13, and a line S represents energy of secondary winding S of transformer T.

First, during a period from time t0 to time t1, igniter control circuit 11 applies an H-level ignition signal to a gate of igniter switch Q1. Hence, igniter switch Q1 is on during the period from time t0 to time t1.

Then, a current is fed from battery E to the ground via igniter winding P1 and igniter switch Q1, and the energy is stored in igniter winding P1. At this time, electric potential on a winding finish side of igniter winding P1 is higher than electric potential on a winding start side thereof. Accordingly, electric potential on a winding finish side of secondary winding S is higher than electric potential on a winding start side thereof as well. For this reason, diode D5 on the secondary winding side is turned off and no secondary current flows thereon.

Next, at time t1, igniter control circuit 11 applies an L-level ignition signal to the gate of igniter switch Q1. Hence, igniter switch Q1 is turned off. Here, the electric potential on the winding start side is higher than the electric potential on the winding finish side in each of igniter winding P1 and secondary winding S. Accordingly, the secondary current flows from the winding start side of secondary winding S via diode D5 and shunt resistor Rs and the energy is supplied to plug 16. The energy of secondary winding S is supplied to plug 16 and therefore gradually reduced over period T1 from time t1 to time t3.

Meanwhile, at time t1, the L-level ignition signal from igniter control circuit 11 is inverted to the H level by inverter 12. Thus, the H-level ignition signal is supplied to the gate of MOSFET Q2 via buffer circuit 14. As a consequence, MOSFET Q2 is on during a period from time t1 to time t4.

Next, delay circuit 13*a* delays the H-level ignition signal inverted by inverter 12 for a predetermined time period starting from time t1. At time t2 (at time in the middle of time t1 and time t3) after the delay for the predetermined time period, DC/DC converter 13 is activated for a period from time t2 to time t4. DC/DC converter 13 boosts the voltage of battery E and supplies the boosted voltage to the anodes of four diodes D1 to D4 that are connected in parallel.

As a consequence, concerning diode D1, the current is fed from DC/DC converter 13 to MOSFET Q2 via diode D1 and energy superposition winding P2. As with the case of diode D1, concerning each of diodes D2 to D4, the current is fed from DC/DC 13 to the corresponding MOSFET via diode D2, D3, or D4 and a constituent component corresponding to energy superposition winding P2.

At this time, electric potential on a winding start side is higher than electric potential on a winding finish side in each of energy superposition winding P2 and secondary winding S. Accordingly, the secondary current flows from the winding start side of secondary winding S via diode D5 and shunt resistor Rs and the energy is supplied to plug 16. Thus, the energy of energy superposition winding P2 is superposed on secondary winding S over a period T2 from time t2 to time t4.

In other words, by feeding the current from auxiliary DC/DC converter 13 to energy superposition winding P2, the energy from energy superposition winding P2 is supplied from secondary winding S to plug 16 at the timing (the period from time t1 to time t3) when fly-back energy of secondary winding S is reduced. Thus, a time period to supply the secondary current is extended and ignition time of plug 16 is extended accordingly.

As described above, according to the ignition device of Example 1, igniter control circuit 11 and inverter 12 which serve as the drive device feed the secondary current to secondary winding S by changing igniter switch Q1 from the on-state to the off-state, and supply the output from DC/DC converter 13 to energy superposition winding P2 by changing MOSFET Q2 from the off-state to the on-state, thereby extending the time period to supply the secondary current. It is therefore possible to extend the ignition time of plug 16 and thus to improve combustion efficiency of fuel.

Meanwhile, since the energy is supplied to plug 16 via energy superposition winding P2, the configurations of igniter winding P1 and secondary winding S can be designed regardless of the energy to be superposed on secondary winding S. Accordingly, it is possible to improve the combustion efficiency of the fuel while suppressing an increase in size of transformer T or reduction in efficiency of the ignition device.

In the meantime, DC/DC converter 13 continues to supply the electric energy to energy superposition winding P2 during the period when MOSFET Q2 is in the on-state, in such away that the secondary current is controlled at the constant value. Accordingly, a fluctuation of electrical stress to be applied to constituent components of DC/DC converter 13 is reduced and reliability of the ignition device is thereby improved.

Meanwhile, MOSFET Q2 is turned on earlier by a predetermined time period than the activation of DC/DC converter 13 and in the state where a relatively low voltage is applied thereto. Accordingly, electrical stress is reduced when turning MOSFET Q2 on.

In the meantime, DC/DC converter 13 repeats start and stop in response to the ignition signal. This configuration suppresses heat generation from the constituent components of DC/DC converter 13 and thus improves the reliability of the ignition device.

Figure 3:
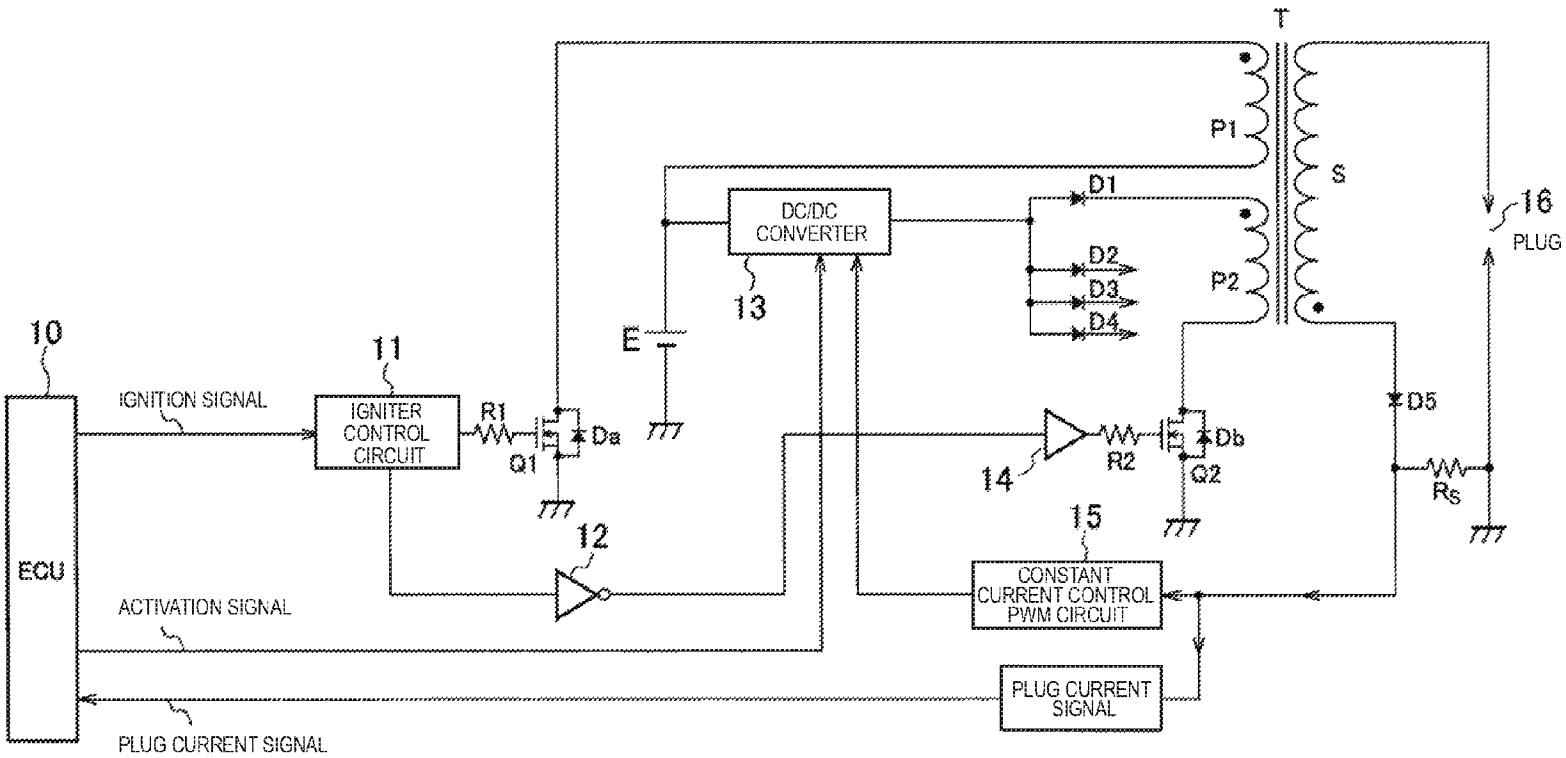
FIG. 3 is a diagram illustrating a circuit configuration of an ignition device according to a modified example.
Figure 4:
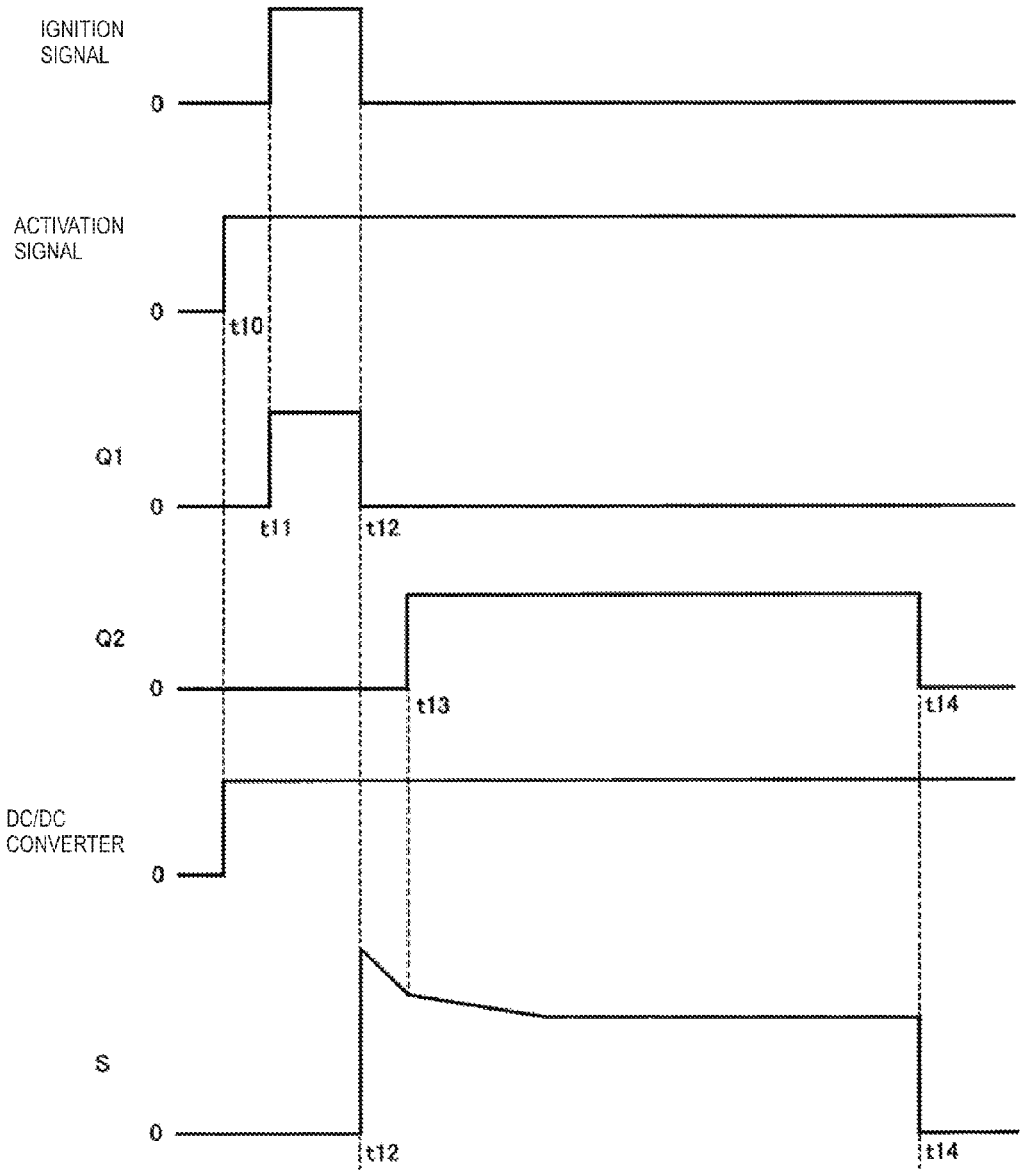
FIG. 4 is an operation waveform diagram regarding constituents of the ignition device according to the modified example.

As illustrated in FIG. 3, delay circuit 13*a* may be omitted and DC/DC converter 13 may be activated at the same time as turning MOSFET Q2 on. Meanwhile, as illustrated in FIG. 4, DC/DC converter 13 may be activated by an activation signal different from the ignition signal, and may continue a boosting operation regardless of the state of MOSFET Q2. In the latter case, the output from DC/DC converter 13 is supplied to energy superposition winding P2 at the timing when the flyback energy of secondary winding S is reduced. In this case, electrical stress to be applied to transformer T and a secondary side circuit is reduced and the reliability of the ignition device is improved.

Figure 5:
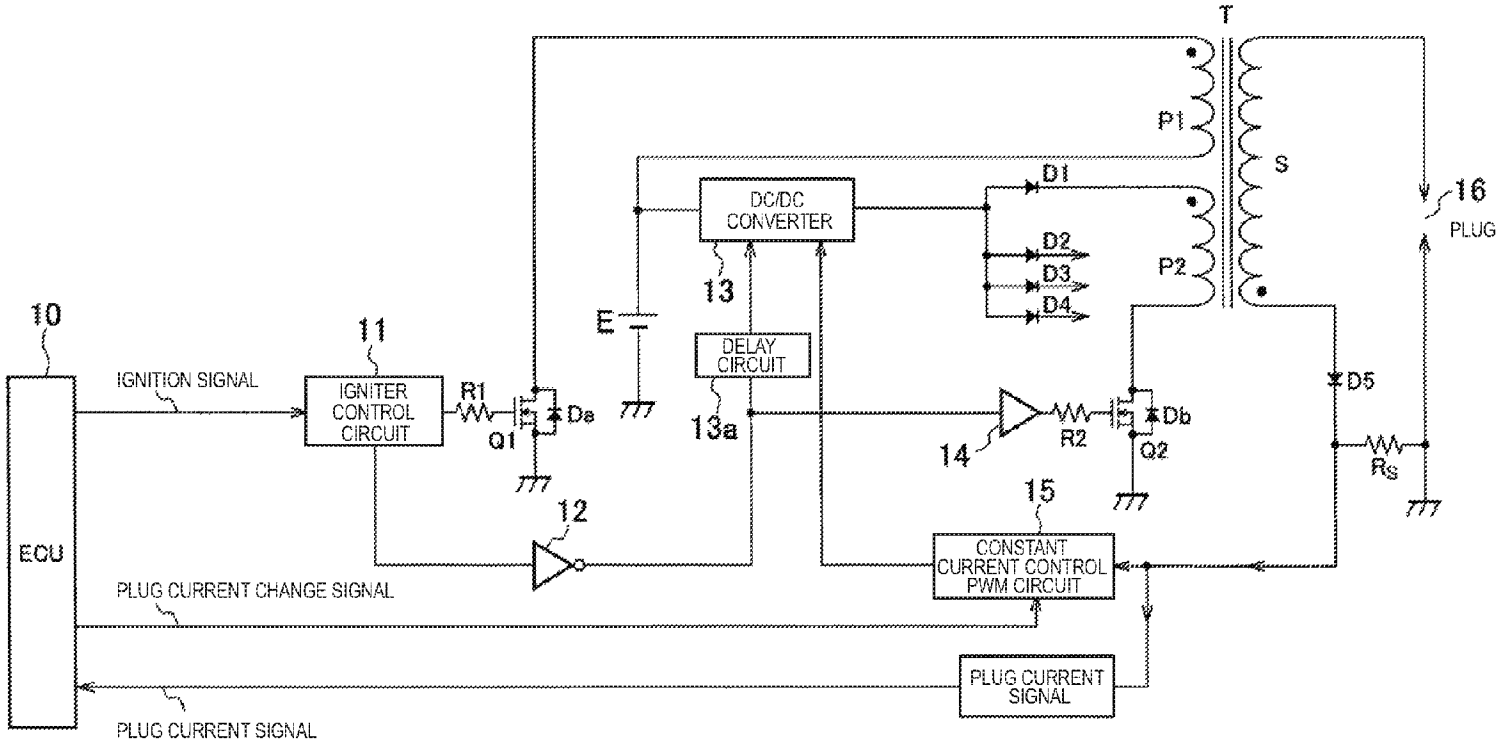
FIG. 5 is a diagram illustrating a circuit configuration of an ignition device according to another modified example.

Meanwhile, as illustrated in FIG. 5, engine control unit (ECU) 10 may be configured to output the ignition signal to igniter control circuit 11 and to output a plug current change signal to constant current PWM circuit 15. In this case, constant current control PWM circuit 15 outputs the internal signal for increasing or decreasing the secondary current to DC/DC converter 13 while adjusting the internal reference value in accordance with the plug current change signal. The increase in secondary current can prevent an accidental fire.

Transformer Ta of the technique disclosed in Patent Document 1 is configured to generate a high voltage on a secondary side and therefore has a high winding number ratio as the transformer. Accordingly, the energy stored in transformer Ta is significantly consumed by voltage conversion. For this reason, transformer Ta can supply the current to plug 16 only for a short time, and the ignition time of plug 16 is therefore limited. As a consequence, combustion efficiency of fuel is reduced and there is a concern of deterioration of exhaust gas due to incomplete combustion of part of the fuel.

According to the embodiment, the drive device feeds the secondary current to the secondary winding by changing the first switch from the on-state to the off-state, and supplies the output from the booster to the third winding by changing the second switch from the off-state to the on-state. Thus, it is possible to extend the ignition time of the plug, and thus to improve the combustion efficiency of the fuel.

As described above, the embodiment can provide the ignition device, which is capable of improving the combustion efficiency of the fuel by extending the ignition time of the plug.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An ignition device comprising:

an ignition coil including a first winding, a second winding, and a third winding electromagnetically coupled to one another;

a first switch electronically connected to a first end of the first winding;

a battery electronically connected to a second end of the first winding;

a booster with a first end electronically connected to the battery and a second end electronically connected to a first end of the third winding;

a second switch electronically connected to a second end of the third winding; and a drive device electrically connected to the first and the second switches, that turns the first and the second switch on and off, wherein the drive device feeds a secondary current to the second winding by changing the first switch from an on-state to an off-state, and supplies an output from the booster to the third winding by changing the second switch from an off-state to an on-state.

2. The ignition device of claim 1, wherein the booster continues to supply electric energy to the third winding during a period when the second switch is in the on-state.

3. The ignition device of claim 1, wherein the booster detects the secondary current flowing into the second winding of the ignition coil, and controls the detected secondary current at a constant value.

4. The ignition device of claim 2, wherein the booster detects the secondary current flowing into the second winding of the ignition coil, and controls the detected secondary current at a constant value.

5. The ignition device of claim 1, wherein the booster starts supply of electric energy after a lapse of a predetermined time period from a point when the second switch is changed from the off-state to the on-state.

6. The ignition device of claim 1, further comprising a delay circuit electrically connected to the drive device and the booster, the delay circuit delays signals from the drive device by a predetermined time period and outputs the signals to the booster.

7. The ignition device of claim 6, further comprising a plurality of diodes, each diode electrically connected to the booster, wherein one of the diode is connected to a second end of the third winding.

8. The ignition device of claim 7, wherein the booster starts supply of electric energy to the plurality of diodes after a lapse of a predetermined time period from a point when the second switch is changed from the off-state to the on-state.

9. The ignition device of claim 1, further comprising a plurality of diodes, each diode electrically connected to the booster, wherein one of the diode is connected to a second end of the third winding.

* * * * *